US012285075B2

(12) United States Patent
Crisafulli et al.

(10) Patent No.: US 12,285,075 B2
(45) Date of Patent: Apr. 29, 2025

(54) HEIGHT ADJUSTABLE SHOE HEEL

(71) Applicant: Trillytech S.r.l., Rome (IT)

(72) Inventors: Veronica Crisafulli, Rome (IT); Alessandro Filosa, Rome (IT)

(73) Assignee: Trillytech S.r.l., Rome (IT)

( * ) Notice: Subject to any disclaimer, the term of this patent is extended or adjusted under 35 U.S.C. 154(b) by 245 days.

(21) Appl. No.: 18/002,089

(22) PCT Filed: Jun. 3, 2021

(86) PCT No.: PCT/IB2021/054847

§ 371 (c)(1),
(2) Date: Dec. 16, 2022

(87) PCT Pub. No.: WO2022/003448

PCT Pub. Date: Jan. 6, 2022

(65) Prior Publication Data

US 2023/0225457 A1 Jul. 20, 2023

(30) Foreign Application Priority Data

Jun. 30, 2020 (IT) ..... 102020000015763

(51) Int. Cl.
*A43B 21/437* (2006.01)
*A43B 7/38* (2006.01)
*A43B 21/48* (2006.01)

(52) U.S. Cl.
CPC ..... *A43B 21/437* (2013.01); *A43B 7/38* (2013.01); *A43B 21/48* (2013.01)

(58) Field of Classification Search
CPC ..... A43B 21/437; A43B 21/48; A43B 21/42; A43B 21/433; A43B 3/246; A43B 7/38
See application file for complete search history.

(56) References Cited

U.S. PATENT DOCUMENTS

| | | | | |
|---|---|---|---|---|
| 3,805,418 A * | 4/1974 | Matuka | ..... | A43B 21/50 36/34 A |
| 6,021,586 A | 2/2000 | Bucalo | | |
| 10,426,218 B2 * | 10/2019 | Harvey | ..... | A43B 21/42 |
| 2016/0235161 A1 | 8/2016 | Edwin | | |

FOREIGN PATENT DOCUMENTS

| | | | | |
|---|---|---|---|---|
| BR | 202016030150 U2 * | 7/2018 | ..... | A43B 21/48 |
| FR | 2959646 A1 | 11/2011 | | |
| GB | 2511150 A | 8/2014 | | |
| KR | 20020032276 A * | 5/2002 | ..... | A43B 21/437 |
| WO | 2010122527 A2 | 10/2010 | | |

* cited by examiner

*Primary Examiner* — Jameson D Collier
(74) *Attorney, Agent, or Firm* — David Guerra

(57) ABSTRACT

A shoe with a heel that is adjustable in height. The heel includes a hollow body fastened to a sole of the shoe, and provided with grooves arranged at different heights from one another. A group of components including a lever are inserted into the hollow body for mutual sliding. A button is connected to the lever for causing rotation of the lever. A locking element is connected to the lever to switch from a locked position to a sliding position. In the locked position, the locking element is inserted into a groove of the hollow body, whereby the group of components and the hollow body are mutually locked in position. In the sliding position, the group of components and the hollow body can mutually slide. An elastic member is arranged to exert a force which brings the locking element from the sliding position to the locked position.

11 Claims, 10 Drawing Sheets

HEIGHT ADJUSTABLE SHOE HEEL

FIELD OF THE INVENTION

The present invention relates to the field of shoes with a heel which is adjustable in height. In particular, the invention relates to a height adjustable heel of a women's shoe, and more particularly to a women's shoe of the non-sports type.

BACKGROUND ART

Women's shoes are often provided with a heel. Generally, the height of the heel cannot be modified.

Certain manufacturers have proposed shoes with a removable and interchangeable heel, in which the heel may be removed and replaced with another heel of a different height.

However, this solution is not very practical, in particular because there is a need to have replacement heels available.

Thus, a shoe in which the heel is foldable has also been proposed, in particular in which the heel may be rotated and accommodated in a seat obtained in the sole.

To date, the need is felt for a heel configured so that the height thereof may be adjusted in an easier and safer manner and adapted to have at least two or at least three different heights.

A problem occurring when the heel height of a shoe is modified is the disadvantageous variation of the ergonomics of the shoe caused by the variation in the height of the heel.

Indeed, the ergonomics of shoes is optimized only for one heel height.

Thus, if the heel height in a shoe is varied, the ergonomics of the shoe is no longer optimal.

In particular, by varying the height of the heel, an undesired raising of the tip of the shoe occurs which, in addition to being unaesthetic, negatively affects the ergonomics of the shoe.

Therefore, the need is also felt for a shoe provided with a heel which is height adjustable in an easy and safe manner, which in particular also allows maintaining the ergonomics at all the possible heights of the heel.

SUMMARY OF THE INVENTION

It is an object of the present invention to provide a heel of a shoe, in particular a women's shoe, the height of which is adjustable in an easy and safe manner.

In particular, in this context, a heel adapted to have at least two or at least three different heights is to be made.

It is another object of the present invention to provide a shoe with a height adjustable heel, which is ergonomic at all heights of the heel.

The present invention achieves at least one of such objects, and other objects which will become apparent in light of the present description, by means of a shoe heel which is height adjustable so as to have at least two positions, to which a respective height of the heel corresponds, at which it may be locked; the heel comprising:

- a hollow body adapted to be fastened to the sole of the shoe, provided with grooves arranged at different heights from one another;
- a group of components at least partially inserted into the hollow body, the group of components and the hollow body being adapted to mutually slide;

said group of components comprising

- a lever;

- a button connected to the lever, adapted to cause a rotation of the lever;
- at least one locking element connected to the lever so as to switch from a locked position, in which said at least one locking element is inserted into a groove of the hollow body, whereby the group of components and the hollow body are mutually locked in position, to a sliding position, in which the group of components and the hollow body can mutually slide;
- elastic means arranged so as to exert a force which brings said at least one locking element from the sliding position to the locked position.

The heel proposed provides the possibility of easily and quickly adjusting the height thereof. Moreover, the heel is particularly safe because it allows maintaining the desired height when the shoe is worn.

The heel may be curved or straight in all embodiments. However, the curved configuration is preferred because it allows obtaining improved ergonomics of the shoe.

Preferably, in all embodiments the heel may be height adjusted so as to have at least three positions, e.g. three positions, at which it can be locked, to which a respective heel height corresponds.

The invention also relates to a shoe according to claims 9 and 10.

Preferably and advantageously, the sole of the shoe comprises a rear zone, to which the heel is restrained, and a front zone, between which there is a zone adapted to be deformed when the heel switches from a first position to a second position of said at least two positions, and vice versa;

whereby the relative orientation between the rear zone and the front zone may vary according to the height of the heel.

In this case, the relative orientation or inclination between the rear zone and the front zone varies according to the height of the heel, in particular when the base of the heel is in contact with the ground.

Therefore, the sole adapts according to the height of the heel, thus allowing the ergonomics of the shoe to be maintained, at any height of the heel.

The aforesaid zone allows varying the relative inclination between the rear zone and the front zone according to the height of the heel.

Indeed, the aforesaid zone is deformable, in particular reversibly deformable, more specifically it is flexible.

Therefore, the undesired raising of the front zone, in particular of the tip of the shoe, advantageously is avoided.

Further features and advantages of the invention will become more apparent in light of the detailed description of non-exclusive embodiments.

The dependent claims describe particular embodiments of the invention.

BRIEF DESCRIPTION OF THE DRAWINGS

In the description of the invention, reference is made to the accompanying drawings, which are provided by way of a non-limiting example, in which.

The same elements or components have the same reference numerals.

DESCRIPTION OF EXEMPLARY EMBODIMENTS OF THE INVENTION

With reference to the drawings, example of embodiments of a heel 1 according to the invention are described.

Figure 1:
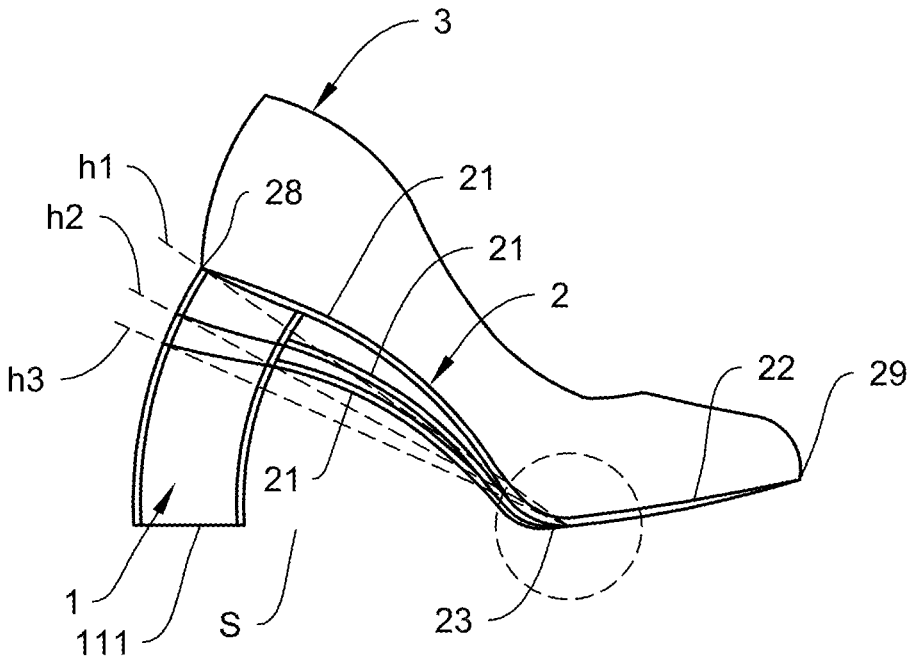
FIG. 1 diagrammatically shows a shoe according to invention, in three different configurations.
Figure 2:
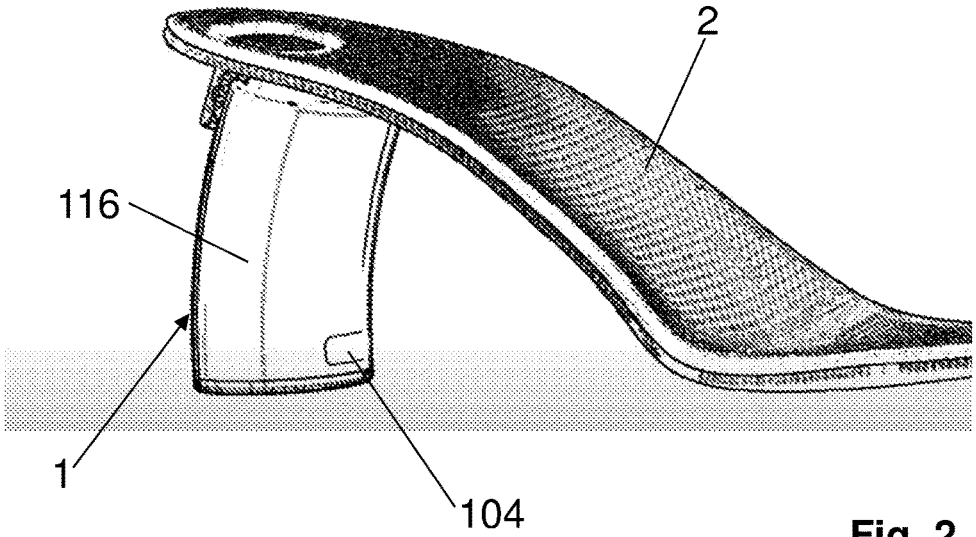
FIG. 2 shows a perspective view of a part of the shoe in FIG. 1, in one configuration.
Figure 3:
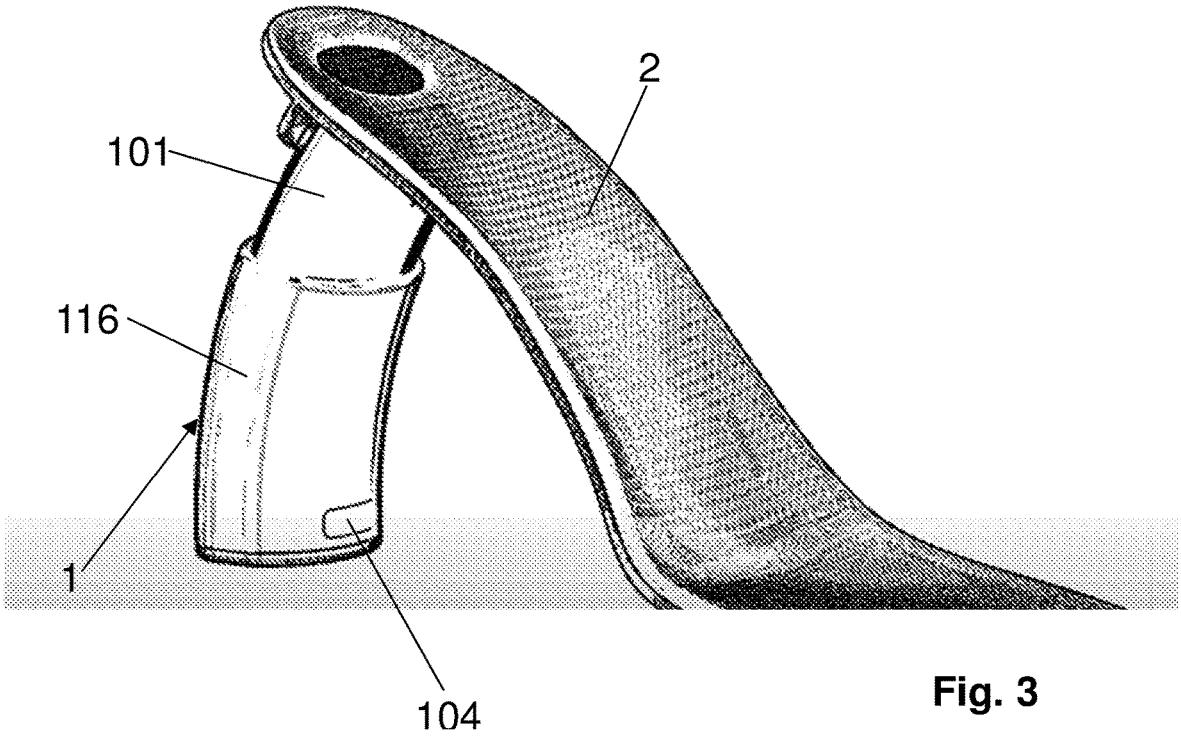
FIG. 3 shows a perspective view of a part of the shoe in FIG. 1, in another configuration.
Figure 4:
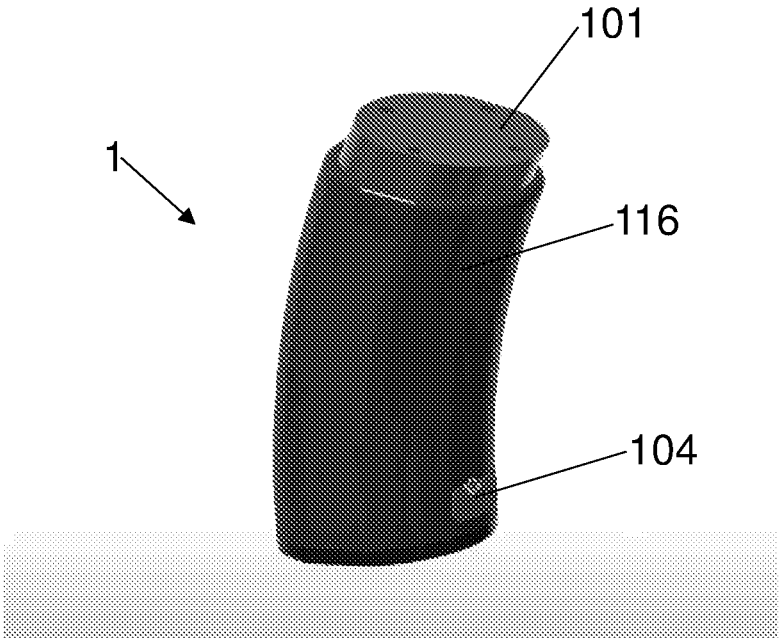
FIG. 4 shows a perspective view of a heel according to the invention, in one configuration.
Figure 5:
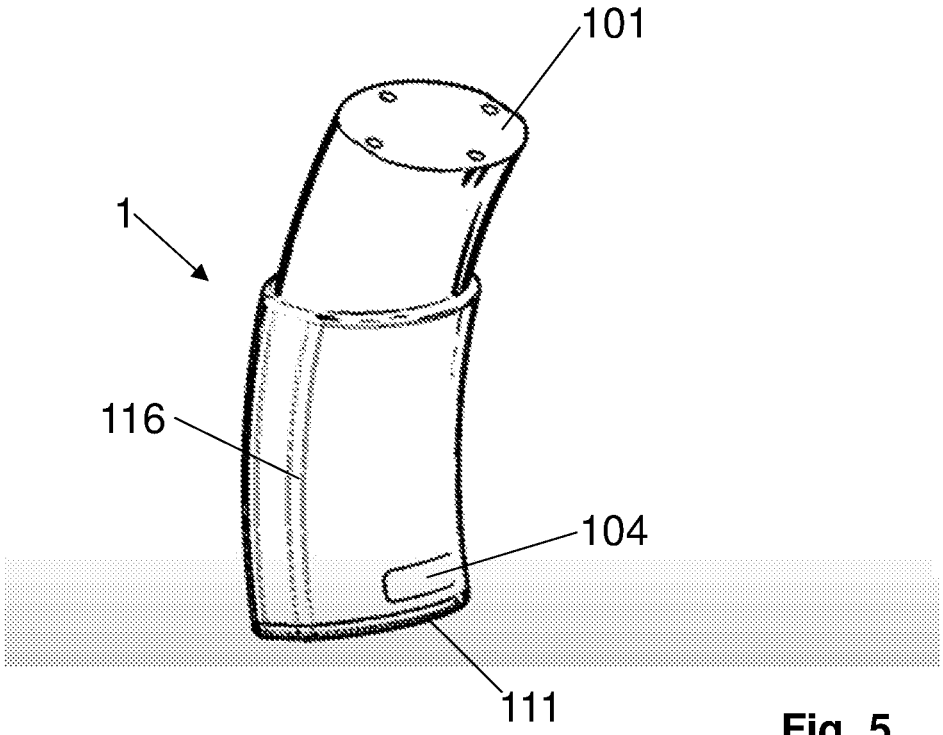
FIG. 5 shows a perspective view of the heel in FIG. 4, in another configuration.
Figure 6:
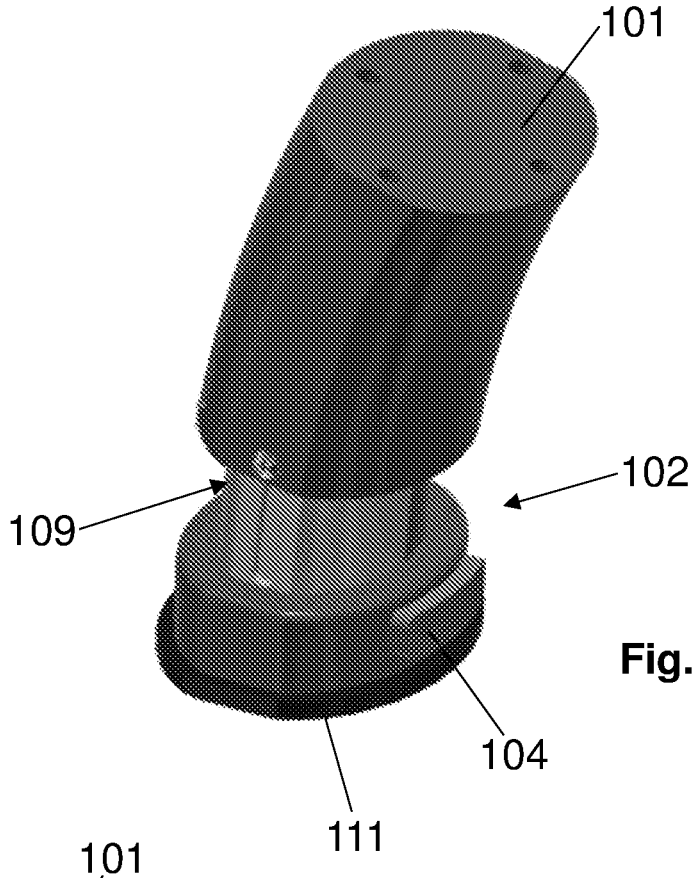
FIG. 6 shows a perspective view of some components of the heel in FIG. 4.
Figure 7:
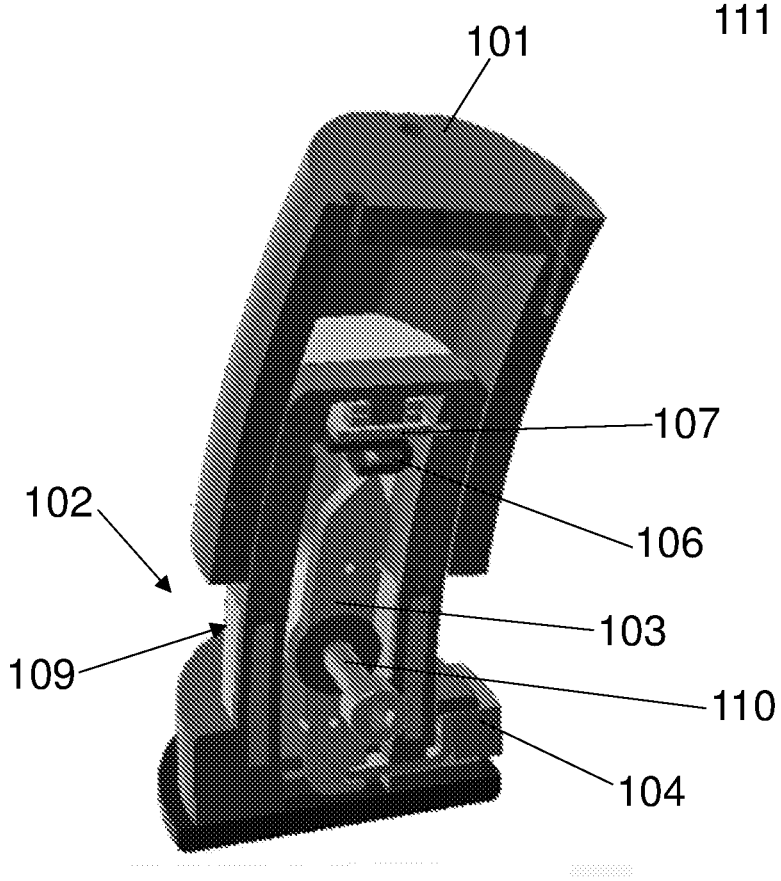
FIG. 7 shows a perspective view of some components shown in FIG. 6.
Figure 8:
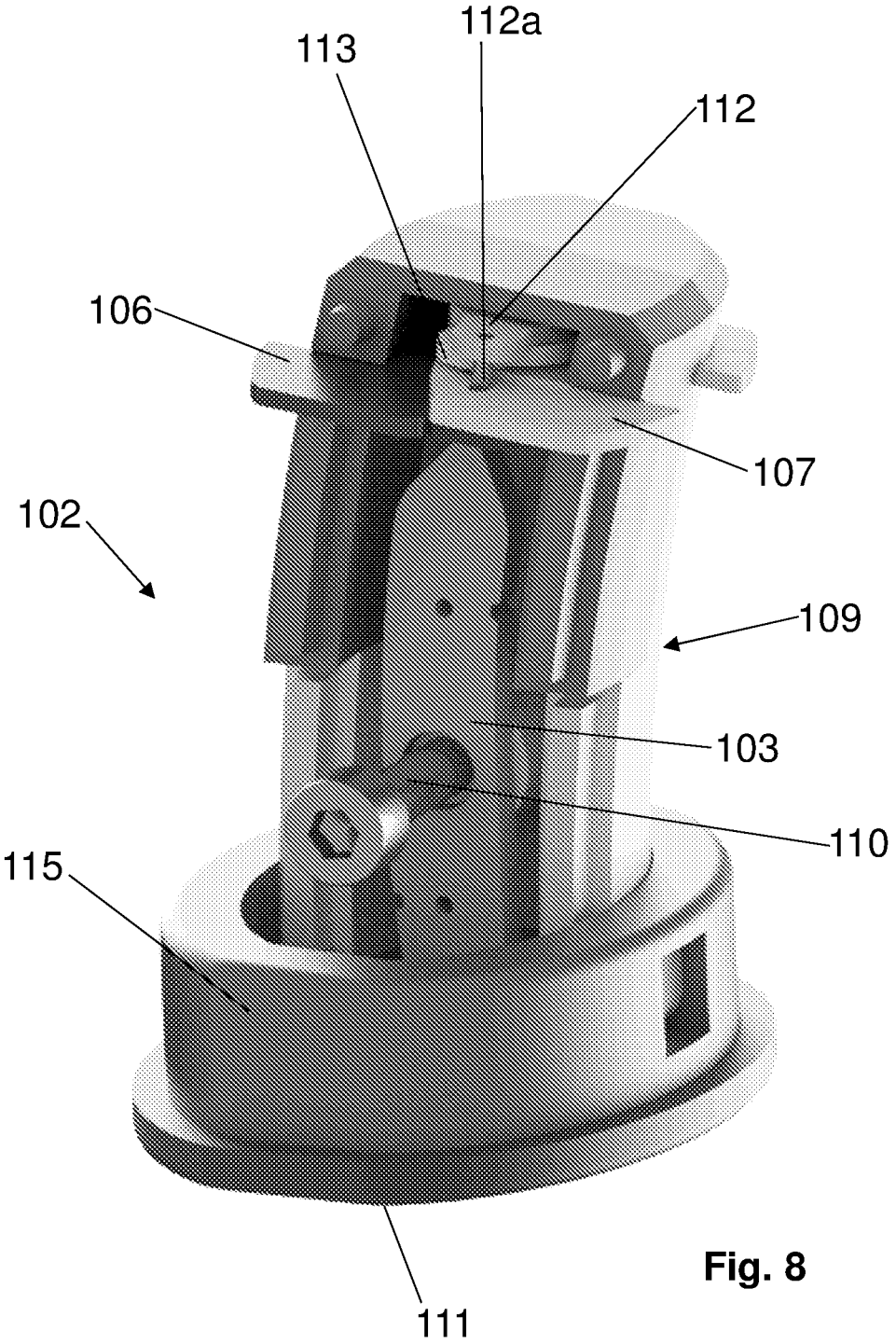
FIG. 8 shows a perspective view of some components of the heel in FIG. 4.

FIGS. 1, 2 and 3 diagrammatically show a shoe 3 comprising a heel 1. The shoe 3 in particular is a women's shoe and more specifically, a women's shoe of the non-sports type.

In particular, the shoe 3 comprises a heel 1 and a sole 2 restrained to each other, in particular fixed to each other. Sole 2 preferably is the part which in the field is known as "soletto" in Italian.

Heel 1 may be adjusted in height so as to have at least two or at least three positions or configurations, to which a respective height h1, h2, h3 of the heel 1 corresponds, at which it can be locked.

In the examples shown, heel 1 may be locked in three positions or configurations, i.e. it may have three different heights h1, h2, h3. In the drawings, height h1 is higher than height h2, and height h2 is higher than height h3.

Preferably, the part of the heel 1 adapted to come into contact with ground S is always the same in all the positions, or heights, and in particular is the base 111 of heel 1.

Figure 9:
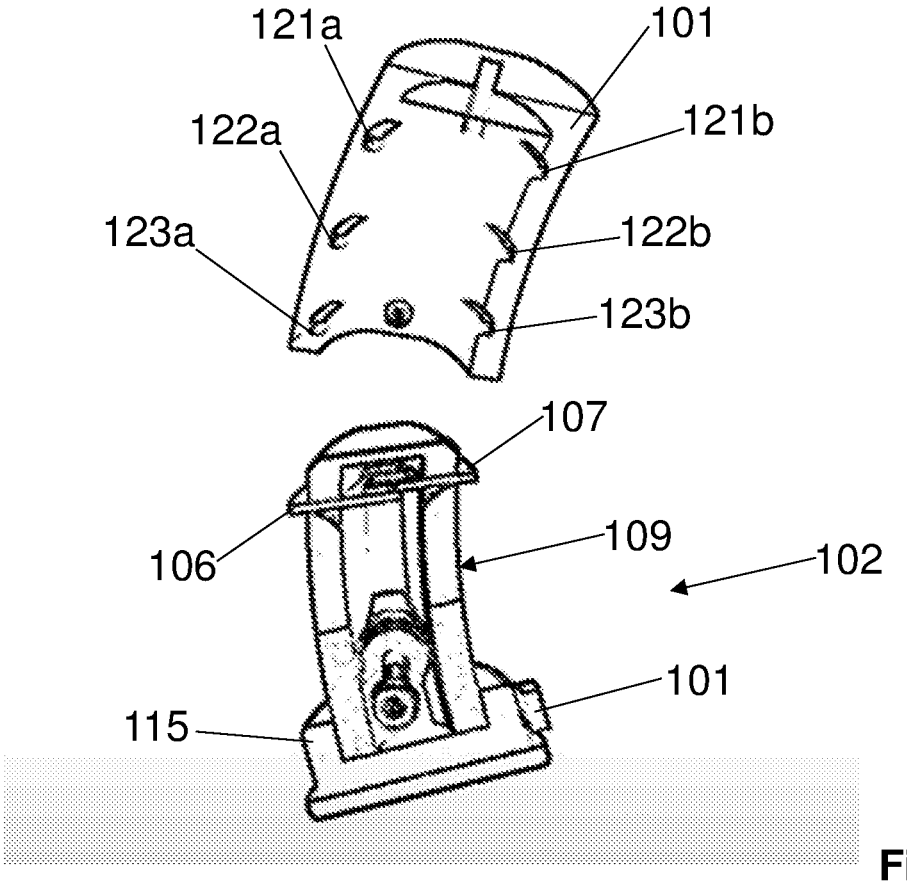
FIG. 9 diagrammatically shows a perspective view of some components of the heel in FIG. 4.

The heel 1 comprises:

- a hollow body 101 adapted to be fastened to sole 2 of the shoe, provided with grooves 121*a*, 121*b*, 122*a*, 122*b*, 123*a*, 123*b* (FIGS. 9 and 10) arranged at different heights from one another, for example wherein at least some are at different heights from one another;
- a group 102 of components at least partially inserted into the hollow body 101, the group 102 of components and the hollow body 101 being adapted to mutually slide.

The group 102 of components comprises:

- a lever 103;
- a button 104 connected to lever 103, adapted to cause a rotation of lever 103;
- at least one locking element 106, 107 connected to lever 103 so as to switch from a locked position, in which said at least one locking element 106, 107 is inserted into a groove 121*a*, 121*b*, 122*a*, 122*b*, 123*a*, 123*b* of the hollow body 101, whereby the group 102 of components and the hollow body 101 are mutually locked in position, to a sliding position, in which the group 102 of components and the hollow body 101 can mutually slide;
- elastic means 108 arranged so as to exert a force which brings said at least one locking element 106, 107 from the sliding position to the locked position.

More generally, heel 1 comprises at least two parts 101, 102 adapted to slide with respect to each other, in particular one in the other. Indeed, the group 102 of components may slide in the hollow body 101.

The upper surface of the hollow body 101 is adapted to be fixed to sole 2.

The aforesaid grooves (or locking areas) 121*a*, 121*b*, 122*a*, 122*b*, 123*a*, 123*b* are made in the inner surface of the hollow body 101, in particular in the inner side surface of the hollow body 101.

In the locked position, said at least one locking element 106, 107 is, in particular, engaged with or fitted in a groove. In particular, said at least one locking element 106, 107 is engaged with said hollow body 101. In the sliding position, in particular, said at least one locking element 106, 107 is disengaged from said grooves, or in other words is disengaged from the hollow body 101.

Preferably, as shown in the drawings, heel 1 comprises two locking elements 106, 107. In any case, another number of locking elements, for example one locking element only, may be provided.

Preferably, three pairs of grooves 121*a*, 121*b*, 122*a*, 122*b*, 123*a*, 123*b* are provided, as shown in the drawings.

The two grooves of each pair substantially are at a same height and are spaced apart from each other, in particular they are opposite to each other.

The pairs of grooves are spaced apart from each other. The pair of grooves 121*a*, 121*b* is at a higher height than the pair of grooves 122*a*, 122*b*, and the pair of grooves 122*a*, 122*b* is at a higher height than the pair of grooves 123*a*, 123*c*. In other words, the pair of grooves 121*a*, 121*b* is distal from the base 111 of heel 1, the pair of grooves 123*a*, 123*b* is proximal to the base 111 of heel 1, and the pair of grooves 122*a*, 122*b* is between the pair of grooves 121*a*, 121*b* and the pair of grooves 123*a*, 123*b*.

A respective height of heel 1 corresponds to each pair of grooves when the two locking elements 106, 107 are inserted therein. For example, the highest height h1 of heel 1 corresponds to the pair of grooves 123*a*, 123*b*; the lowest height h3 of heel 1 corresponds to the pair of grooves 121*a*, 121*b*; and a height h2 of heel 1 which is lower than the maximum height h1 and higher than the minimum height h3 corresponds to the pair of grooves 122*a*, 122*b*.

Instead of pairs of grooves, also a different number of grooves may be provided for each height. For example, a single groove which preferably has a greater extension than each groove of the aforesaid pairs, may be provided for each height.

Heel 1 comprises a housing 109, or casing, which is part of said group 102 of components.

The lever 103 and a pin 110 are arranged inside the housing 109.

Pin 110 is connected to lever 103 and preferably also to housing 109. Lever 103 can rotate about pin 110 when a pressure is exerted on button 104.

Button 104 and the locking elements 106, 107 are connected to lever 103 in mutually opposite areas with respect to pin 110. In particular, button 104 is proximal to the base 111 of heel 1 and the locking elements 106, 107 are distal from the base 111 of heel 1.

The locking elements 106, 107 are arranged inside the housing 109.

Figure 16:
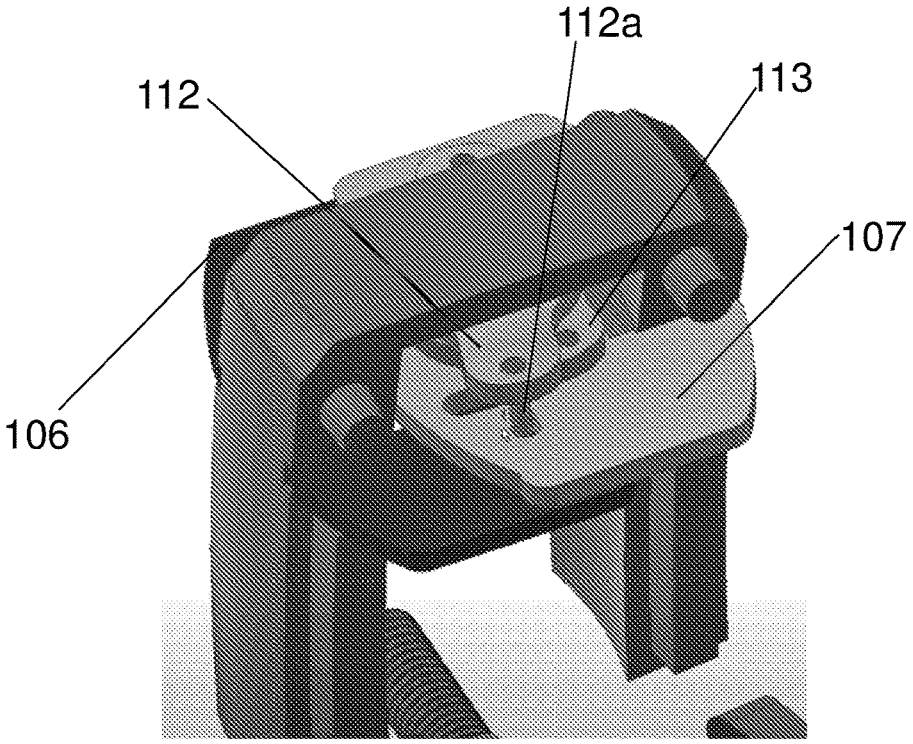
FIG. 16 shows a perspective view of some components shown in FIG. 13.
Figure 17:
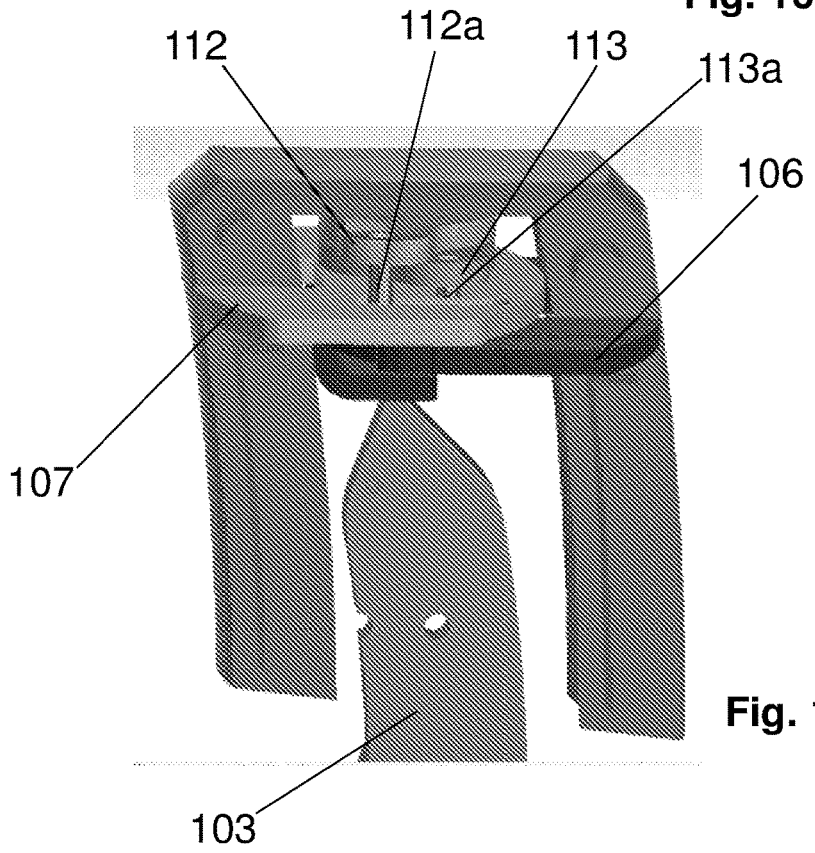
FIG. 17 shows a perspective view of some components shown in FIG. 13.

In FIGS. 10, 13, 14 and 15, in particular, the locking elements 106, 107 are in the locked position. In FIGS. 16 and 17, the locking elements 106, 107 are in the sliding position.

In the locked position, the locking elements 106, 107 cross the housing 109 so that part of each locking element 106, 107 projects outside housing 109. In particular, part of each locking element 106, 107 is inserted into a groove 121*a*, 121*b*, 122*a*, 122*b*, 123*a*, 123*b* so as to prevent a substantial relative motion between the hollow body 101 and the group 102 of components. More in detail, in particular when pairs of grooves are provided, each locking element 106, 107 is inserted into a respective groove of a pair of grooves for each height h1, h2, h3 of the heel 1.

Figure 10:
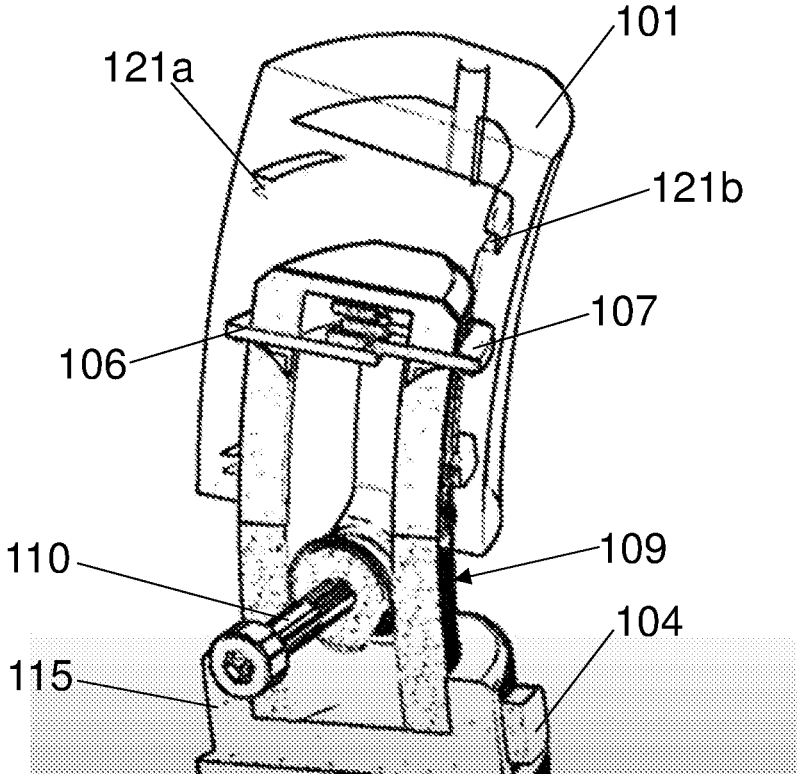
FIG. 10 diagrammatically shows another perspective view of some components of the heel in FIG. 4.

For example, in FIG. 10, part of the locking element 106 is inserted into groove 122*a*; and part of the locking element 107 is inserted into groove 122*b*. The height h2 of heel 1 corresponds to this position.

It should be noted that, in particular, the locking elements 106, 107 project from opposite sides of housing 109.

Preferably, each locking element 106, 107 comprises two arms 106*a*, 106*b*, 107*a*, 107*b* (FIG. 12) joined to each other by a connection portion 106*c*, 107*c*.

In said locked position, at least part of said arms 106*a*, 106*b*, 107*a*, 107*b* projects outside the housing 109 and said connection portion 106*c*, 107*c* is inside housing 109.

Preferably, in said locked position, the connection portion 106*c*, 107*c* is in contact with housing 109, in particular with the inner surface of housing 109.

Preferably, the locking elements 106, 107 partially mutually overlap.

Preferably, the locking element 106 is below the locking element 107.

The locking elements 106, 107 are connected together, in particular so that they move away from each other when switching from the sliding position to the locked position, and vice versa. I.e., the locking elements move towards each other when switching from the locked position to the sliding position. Preferably, the two locking elements 106, 107 simultaneously move in opposite direction from each other. Heel 1 comprises connecting means 112, 113, 112*a*, 113*a* which connect said two locking elements 106, 107 together, in particular so that a translation of the locking elements 106, 107 corresponds to a rotation of lever 103.

More generally, for example, the transmission of the motion from lever 103 to the one or more locking elements 106, 107 may occur by means of linkages, in particular internal linkages. The locking elements 106, 107 preferably are opposite each other. By mere way of non-limiting example, lever 103 is adapted to impart a translation movement to a first locking element 106 of the two locking elements 106, 107. The first locking element 106 is adapted to impart a translation movement to a second locking element 107 of the two locking elements 106, 107 by means of said connecting means 112, 113, 112*a*, 113*a*.

More in detail, for example an end portion of lever 103 is inserted into an opening of the locking element 106 so as to be able to move the locking element 106.

Preferably, said opening of the locking element 106 is made in a portion 161 (FIG. 15, in particular) connected to the connection portion 106*c* and spaced apart from the connection portion 106*c* and from the arms 106*a*, 106*b*.

Preferably, the connecting means comprise two bodies 112, 113, preferably hinged to each other, for example centrally, so as to be adapted to rotate.

In particular, the bodies 112, 113 are hinged by a cylindrical projection 109*a* (FIG. 13) of housing 109. In particular, the outer surface of projection 109*a* is cylindrical. Projection 109*a* in particular extends downwards from an upper surface of housing 109.

The two bodies 112, 113 preferably are arranged above the locking element 107. Each body 112, 113 comprises two end portions from which a respective pin 112*a*, 113*a* extends. The pins 112*a*, 113*a* extend downwards, in particular towards the locking element 106. The pins 112*a*, 113*a* may, for example be inserted into one or more holes and/or one or more guides or tracks of each of the locking elements 106, 107.

The bodies 112, 113 preferably face each other and preferably are spaced apart from each other.

The group 102 of components also comprises the base 111 of heel 1, which is adapted to come into contact with ground S.

In particular, the group 102 of components comprises a component or body 115 which defines the base 111 of heel 1.

In particular, body 115 is fixed to housing 109.

Preferably, button 104 is at least partially arranged in body 115.

Button 104 preferably is adapted to always remain outside the hollow body 101, in particular at any height of heel 1.

Body 115 and the hollow body 101 preferably are configured so as to abut against each other, in particular when heel 1 is in the position of minimum height h3. In particular, body 115 preferably always remains outside the hollow body 101. At least the part of body 115 at button 104 is adapted to always remain outside the hollow body 101.

Preferably, an outer shell 116 is provided (FIGS. 2, 3, 4, 5) in which the hollow body 101 and preferably also part of body 115 are arranged.

The hollow body 101 and the outer shell 116 may mutually slide, in particular so that the hollow body 101 can be partially removed from the outer shell 116. The outer shell 116 is integrally fixed to the group 102 of components, and in particular the group 102 of components is inside the outer shell 116.

The outer shell 116 is provided with an opening through which the user may operate button 104.

Figure 11:
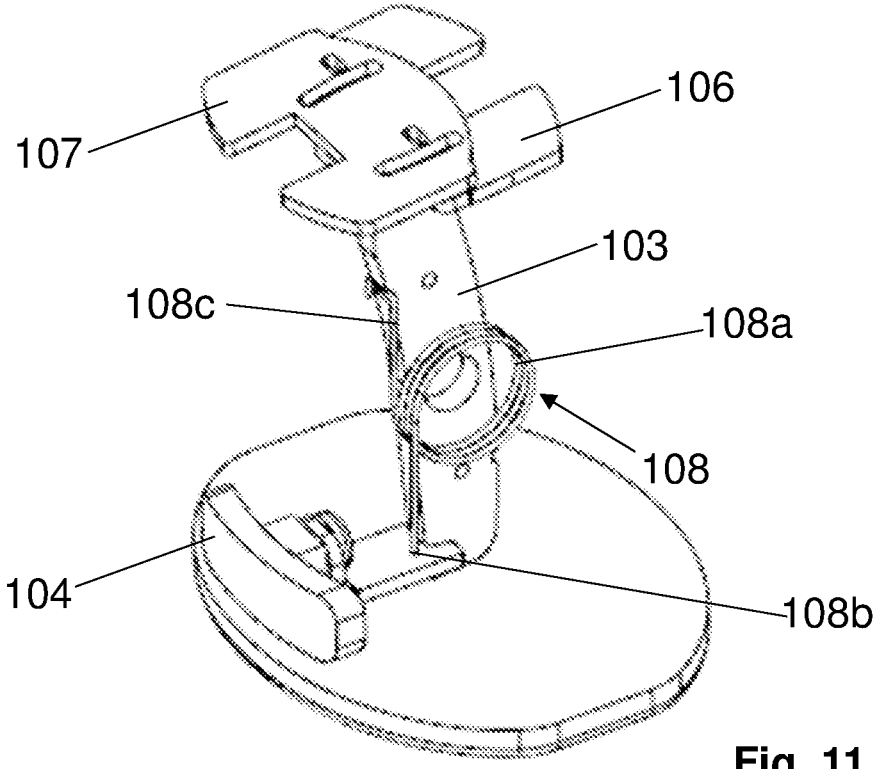
FIG. 11 shows a perspective view of some components of the heel in FIG. 4.
Figure 12:
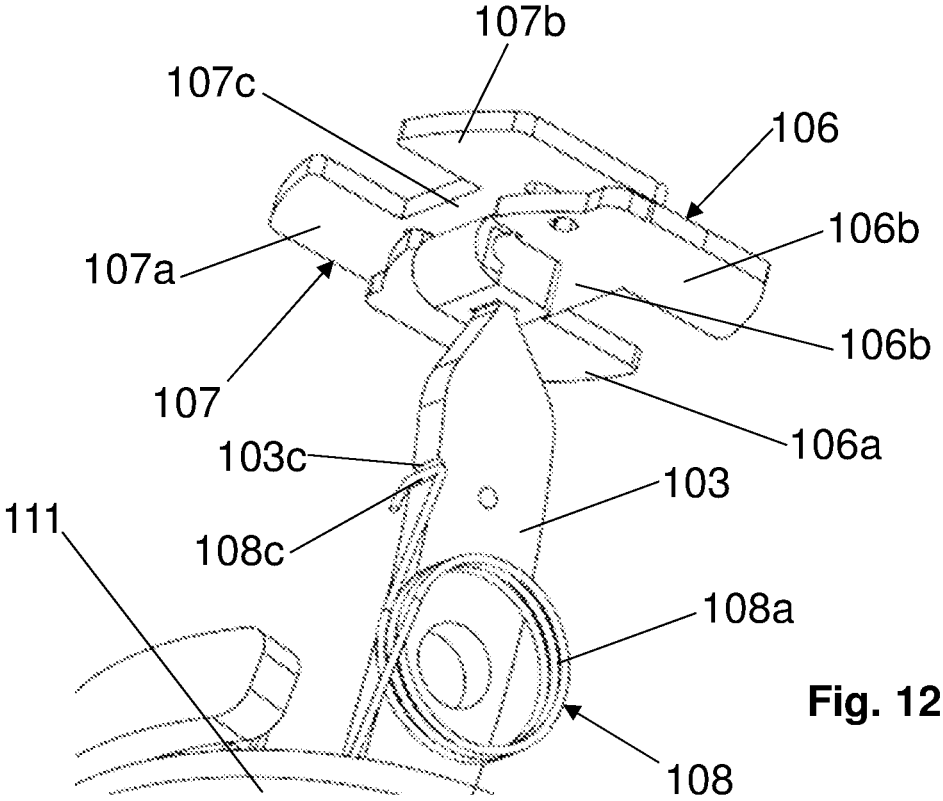
FIG. 12 shows a perspective view of some components shown in FIG. 11.
Figure 13:
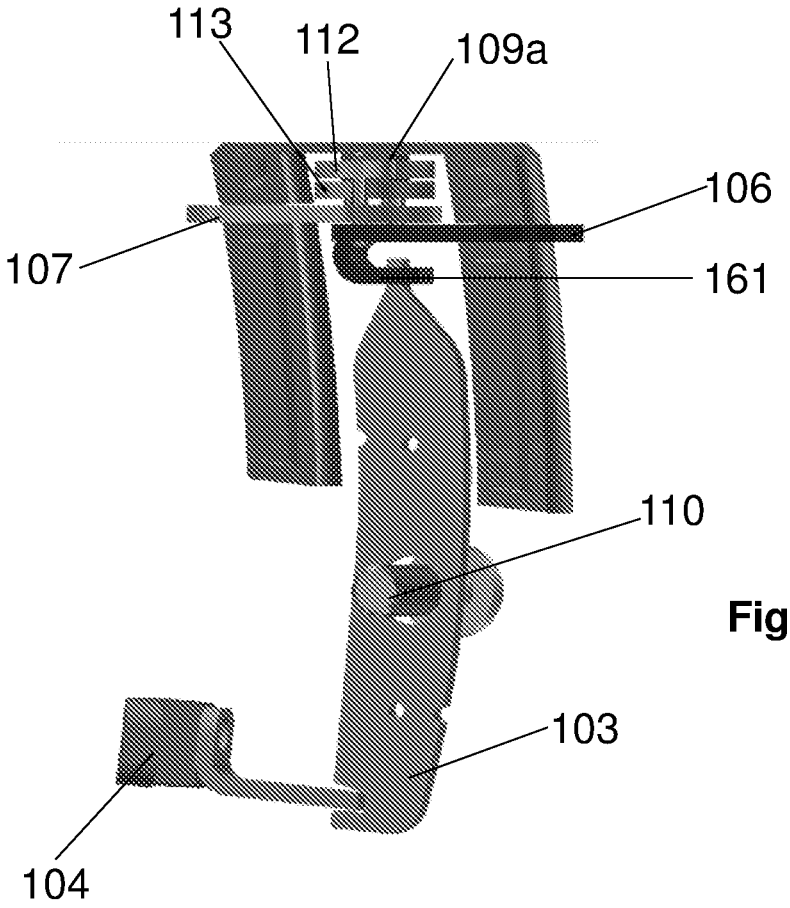
FIG. 13 shows a perspective view of some components of the heel in FIG. 4.
Figure 14:
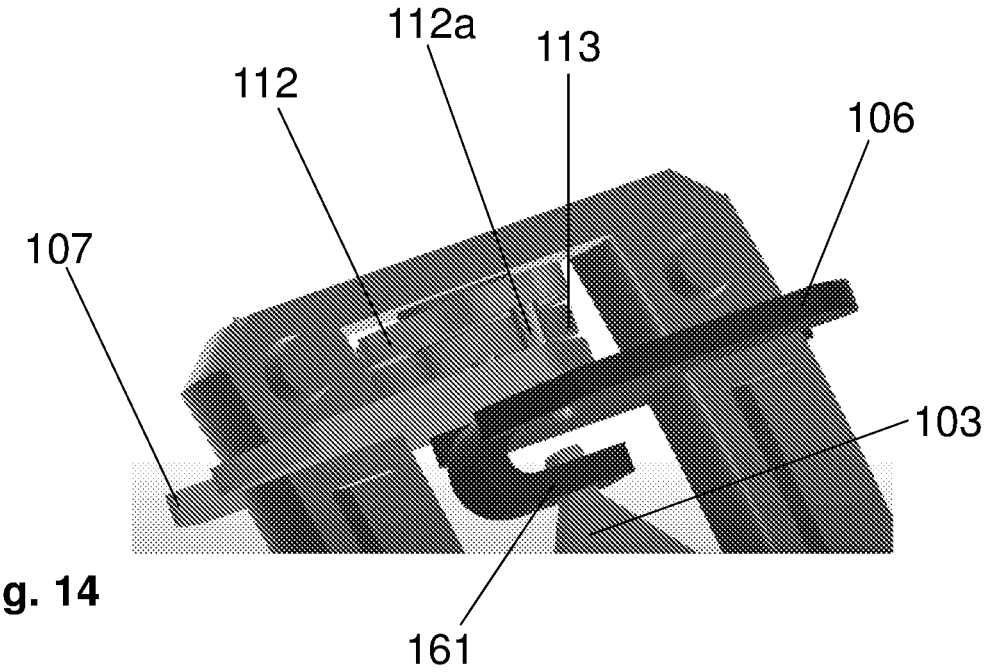
FIG. 14 shows a detail of FIG. 13.
Figure 15:
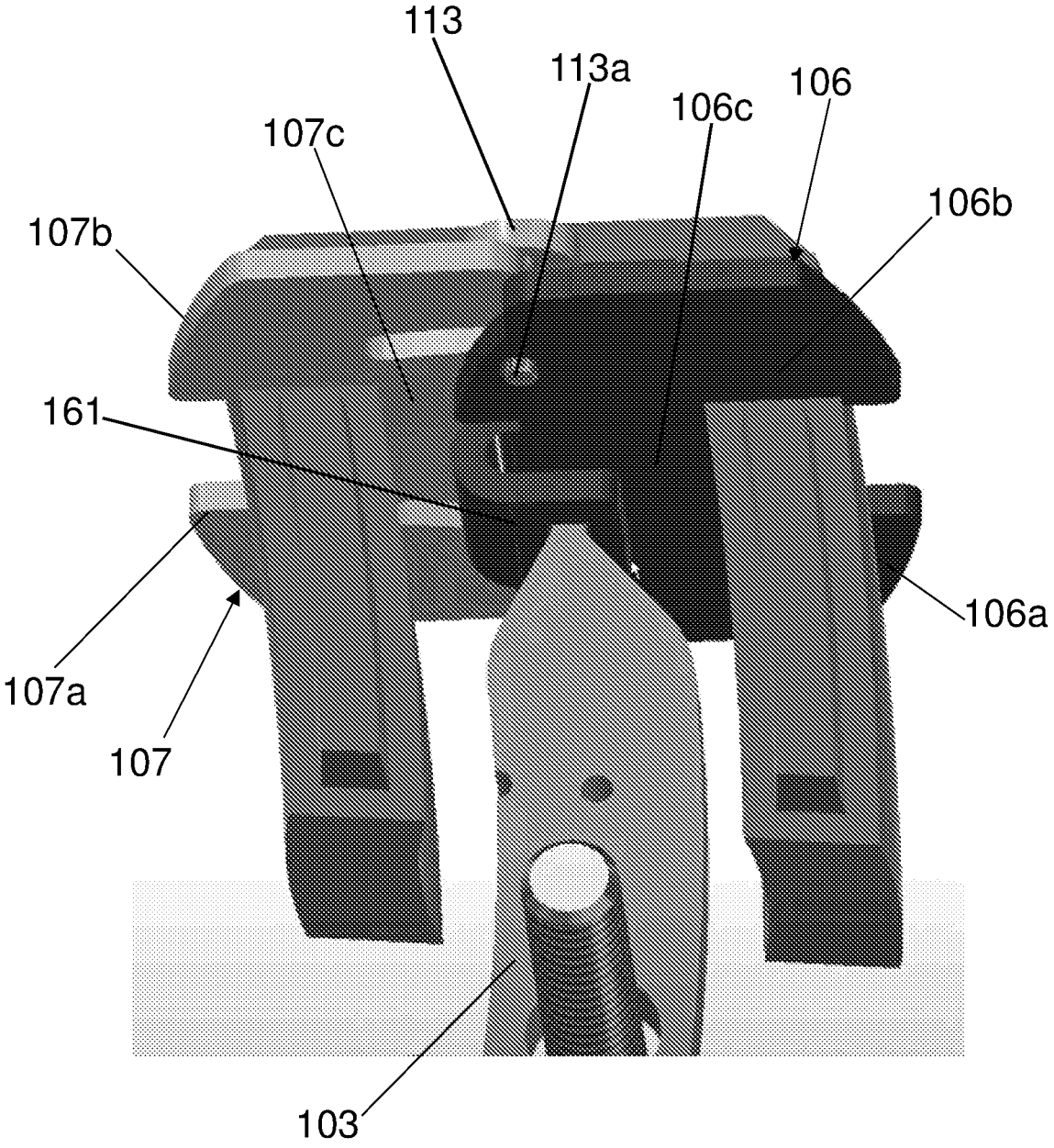
FIG. 15 shows a perspective view of some components shown in FIG. 13.

With particular reference to FIGS. 11 and 12, the elastic means 108, in particular, are arranged so as to be compressed when said at least one locking element (for example two locking elements 106, 107) is in the sliding position.

The elastic means 108, for example comprise or consist of one spring 108.

For example, spring 108 comprises a portion 108*a* which extends about pin 110. Spring 108 also comprises a portion 108*c* inserted into a groove 103*c* (FIG. 12) of lever 103, and a portion 108*b* inserted into a hole of button 104.

To vary the height of heel 1, the user may exert a force on button 104 so as to cause a rotation of lever 103. The rotation of lever 103 causes a movement of the two locking elements 106, 107 in mutually opposite direction, in particular in a direction approaching each other. Both locking elements 106, 107 move towards the inside of heel 1, thus becoming disengaged from the respective groove. The group 102 of components and the hollow body 101 thus may mutually slide. The user may position the locking elements 106, 107 at the pair of grooves 121*a*, 121*b*, 122*a*, 122*b*, 123*a*, 123*b* corresponding to the desired height h1, h2, h3 for heel 1.

When button 104 is released, the locking elements 106, 107 move towards the outside under the effect of spring 108 and are engaged with the pair of grooves, whereby heel 1 remains at the desired height also when the user wears the shoe, in particular even during walking.

As mentioned above, the invention also relates to a shoe comprising a heel 1 and a sole 2, which are restrained to each other.

Sole 2 comprises a rear zone 21, to which heel 1 is restrained, and a front zone 22. Preferably, there is a zone 23 (which is part of sole 2) between the rear zone 21 and the front zone 22 which is adapted to be deformed when heel 1 switches from a first position to a second position of said at least two or at least three positions, and vice versa. In other words, zone 23 is adapted to be deformed when the height h1, h2, h3 of heel 1 is varied. In particular, the connection zone 23 is flexible.

Therefore, the relative orientation or inclination between the rear zone 21 and the front zone 22 advantageously may vary according to the height h1, h2, h3 of heel 1. In particular, the relative orientation or inclination between the rear zone 21 and the front zone 22 varies according to the height of heel 1 when the base 111 of heel 1 is in contact with ground S, more specifically when the shoe is worn.

In particular, as shown in FIG. 1, the angle between the rear zone 21 and the front zone 22 increases as the height of heel 1 decreases. In particular, the aforesaid angle is formed between the upper surfaces of the rear zone 21 and the front zone 22. The upper surface of sole 2, and therefore of the rear zone 21 and of the front zone 22, is the surface opposite to the surface to which the heel 1 is fixed.

Advantageously, the sole 2 adapts according to the height of heel 1, thus allowing the ergonomics of the shoe to be maintained at any height of heel 1.

Preferably, the orientation of the front zone 22, in particular with respect to ground S, substantially remains the same, independently of the height of heel 1. An advantageous aspect is shown in FIG. 1, where the shoe is diagrammatically shown in three different configurations, in particular in which heel 1 has three different heights h1, h2, h3, with h1>h2>h3.

It can be noted that, advantageously, by varying the height of heel 1, the relative inclination between the rear zone 22 and the front zone 21 is also varied. The orientation of the front zone 21 preferably does not change with respect to ground S when the height of heel 1 is changed.

Preferably, zone 23 is proximal to the front end 29 of sole 2 and distal from the rear end 28 of sole 2.

Zone 23 preferably is at a distance from the rear end 28 of sole 2 having a length between 40% and 80%, preferably between 50% and 75%, of the overall length of sole 2. Such a distance was selected on the basis of studies on ergonomics.

Preferably, zone 23 is at a distance from 130 to 190 mm from the rear end 28 of sole 2.

Said distance is, for example measured from the rear end 28 of sole 2 up to the start of zone 23, starting from the rear end 28, in particular following the curve or outline of sole 2.

In particular, the overall length of sole 2 is measured from the rear end 28 to the front end 29 of sole 2. More specifically, the length of sole 2 preferably is measured along sole 2, i.e. following the outline thereof.

Preferably, zone 23 has a width which is substantially equal to the width of sole 2, or in other words, zone 23 extends from a side edge portion of sole 2 to the opposite side edge portion.

Preferably, zone 23 has a length, perpendicularly to the width, of at least 0.5 cm or of at least 1 cm, for example from 0.5 to 6 cm, or from 1 to 4 cm, or from 1 to 2 cm. In addition to zone 23, sole 2 may be provided with other deformable zones, in particular flexible zones, for possibly further improving the ergonomics of the shoe. In general, zone 23 substantially connects the part or front zone 22 of sole 2 with the part or rear zone 21 of sole 2 and may also be defined connection zone 23.

Zone 23 may, for example, be part of the front zone 22. In particular, it may be made of the same material of which the front zone 22 is made. Preferably, the rear zone 21 is made of a different material as compared to the front zone 22, in particular more rigid than the front zone 22.

In a variant, zone 23 may optionally be made of a different material as compared to the rear zone 21 and the front zone 22.

Preferably, the rear zone 21, and optionally also the front zone 22, are substantially rigid, or in any case have a greater rigidity than zone 23.

In all the embodiments, it is particularly preferable that the heel 1 is curved to best maintain the ergonomics of the shoe at any height of heel 1. Heel 1 preferably is curved so as to be concave towards the front zone 22 of sole 2.

By mere way of example, heel 1 may have, for example a curvature from 10° to 90°, preferably from 20° to 60°.

By mere way of example, heel 1 may be curved so that the opposite ends thereof subtend an angle from 10° to 90°, preferably from 20° to 60°.

In any case, heel 1 may also be straight.

The invention claimed is:

1. A shoe heel that is height adjustable so as to have at least two positions, the shoe heel comprising:

a hollow body adapted to be fastened to a sole of a shoe, wherein the hollow body is provided with grooves arranged at different heights from one another;

a group of components at least partially inserted into the hollow body, the group of components and the hollow body being adapted to mutually slide, the group of components comprising a lever;

a button connected to the lever, adapted to cause a rotation of the lever;

at least one locking element connected to the lever so as to switch from a locked position to a sliding position, the locked position being in which the at least one locking element is inserted into one of the grooves of the hollow body, whereby the group of components and the hollow body are mutually locked in position, the sliding position being in which the group of components and the hollow body can mutually slide; and an elastic member configured to exert a force to bring the at least one locking element from the sliding position to the locked position.

2. The shoe heel according to claim 1 further comprising:

a housing inside of which the lever is arranged; and a pin connected to the lever and to the housing, about which the lever can rotate when a pressure is exerted on the button;

wherein the housing is part of the group of components.

3. The shoe heel according to claim 2, wherein the button and the at least one locking element are connected to the lever in mutually opposite areas with respect to the pin.

4. The shoe heel according to claim 2, wherein the at least one locking element is arranged in the housing; and wherein, in the locked position, the at least one locking element crosses the housing, whereby part of the at least one locking element projects outside the housing; wherein the part of the at least one locking element is inserted into one of the grooves of the plurality of grooves.

5. The shoe heel according to claim 2, wherein the at least one locking element comprises two arms joined together by a connection portion; and wherein, in the locked position, at least part of the arms projects outside the housing and the connection portion is inside the housing; wherein, in the locked position, the connection portion is in contact with the housing.

6. The shoe heel according to claim 1, wherein the at least one locking element includes two locking elements connected together, so that the two locking elements move away from each other when switching from the sliding position to the locked position, and vice versa.

7. The shoe heel according to claim 6 further comprising a connecting assembly which connects the two locking elements together so that a translation of the locking elements corresponds to a rotation of the lever; wherein the lever is adapted to impart a translation movement to a first locking element of the two locking elements, and the first locking element is adapted to impart a translation movement to a second locking element of the two locking elements by way of the connecting assembly.

8. The shoe heel according to claim 1, wherein the group of components comprises a base of the heel configured to come into contact with the ground.

9. The shoe heel according to claim 1, wherein the heel is curved or straight.

10. A shoe comprising the height adjustable shoe heel according to claim 1 and further comprising a sole, wherein the heel and the sole are restrained to each other.

11. The shoe according to claim 10, wherein a base of the heel is adapted to come into contact with the ground in the at least two positions;

wherein the sole comprises a rear zone, to which the heel is restrained, and a front zone, between which there is a zone adapted to be deformed when the heel switches from a first position to a second position of the at least two positions, and vice versa;

whereby the relative orientation between the rear zone and the front zone may vary according to the height of the heel; and wherein the zone is arranged at a distance from the rear end of the sole, the distance having a length between 40%-80% of a length of the sole.

* * * * *